United States Patent [19]

Barmettler

[11] Patent Number: 4,975,994

[45] Date of Patent: Dec. 11, 1990

[54] HAMMOCK WITH FRAME

[76] Inventor: Peter Barmettler, Allmendstrasse 9, CH-6374 Buochs, Switzerland

[21] Appl. No.: 526,672

[22] Filed: May 21, 1990

Related U.S. Application Data

[63] Continuation of Ser. No. 199,944, May 27, 1988, abandoned.

[30] Foreign Application Priority Data

Jun. 6, 1987 [CH] Switzerland ..... 02135/87

[51] Int. Cl.[5] ..... A45F 3/22; A45F 3/24

[52] U.S. Cl. ..... 5/120; 5/121; 5/127

[58] Field of Search ..... 5/127, 130, 120, 121, 5/124

[56] References Cited

U.S. PATENT DOCUMENTS

| | | | |
|---|---|---|---|
| 144,219 | 11/1973 | Park | 5/129 |
| 280,081 | 6/1983 | Rich | 5/127 |
| 575,838 | 1/1897 | Hoffman | 5/129 |
| 944,661 | 12/1909 | Buck | 5/129 |
| 2,569,596 | 10/1951 | Anderegg | 5/127 |
| 4,757,563 | 7/1988 | An | 5/121 |

FOREIGN PATENT DOCUMENTS

| | | | |
|---|---|---|---|
| 2422505 | 11/1975 | Fed. Rep. of Germany | 5/127 |
| 2540693 | 1/1977 | Fed. Rep. of Germany | 5/127 |
| 2626007 | 12/1977 | Fed. Rep. of Germany | 5/120 |
| 2702593 | 7/1978 | Fed. Rep. of Germany | 5/127 |
| 2853993 | 7/1980 | Fed. Rep. of Germany | 5/127 |
| 988053 | 8/1951 | France | 5/129 |
| 2307492 | 12/1976 | France | 5/120 |
| 378977 | 3/1940 | Italy | 5/127 |
| 575152 | 4/1958 | Italy | 5/129 |
| 697011 | 10/1965 | Italy | 5/120 |
| 473553 | 5/1967 | Switzerland | 5/127 |

*Primary Examiner*—Alexander Grosz
*Attorney, Agent, or Firm*—Darby & Darby

[57] ABSTRACT

A hammock and a frame wherein the frame has a keel like shaped flexible beam formed by telescopically joined elements and sticklike supporting beam legs. The joint of the beam legs to the beam is accomplished by a bag attached to the frame having a pocket into which the end of a beam leg is inserted. The keel like shape of the frame operates so that overtensioning the flexible beam causes it to deform and function as a safety device. With such deformation of the frame, the user is lowered toward the ground.

10 Claims, 3 Drawing Sheets

HAMMOCK WITH FRAME

This application is a continuation of application Ser. No. 07/199,944, filed May 27, 1988 (now abandoned).

BACKGROUND OF THE INVENTION

The present invention includes a frame and a hammock, wherein the frame for supporting the hammock is a keel like shaped flexible beam which can be dismounted into several elements and joined back together. The deformation of the flexible beam functions as an overtension safety device. The frame also has bearings to join a sun protection umbrella or a tent. Dismantled into single elements, the frame and the hammock can be stored in a bag containing enclosed pockets.

In order to be independent of surface conditions, frames for supporting a hammock, for example in Swiss Pat. No. 473553, have two folding tubes. This arrangement has the disadvantage that the tubes cannot be locked in the using position. With this disadvantage, the frame can overbalance with side swinging because the tubes are moving sidewards. A check lever to lock the folding tubes is shown in German Pat. No. OS 25 40 693. German Pat. No. OS 27 02 593 shows cross supported tubes enabling fixed tube positions.

The devices of these patents have evoked little commercial interest. The design out of the "Heine" catalogue "Garden furniture 1987" shows a U-shaped frame and two supporting tubes in a 90° angle parallel to the ground. The hammock is attached to the ends of the frame, the hammock extending from one end of the frame to the other. The frame is so designed, that with normal force, enough security against breaking is provided. For this reason, the frame's concept is of a stationary, massive design, which can be used in a garden, or on a balcony in warm weather. With this "heavy" design, many of the hammock's portability qualities—first designed by the American Indians—are lost.

Hammocks are usually very light and for that reason can be used extremely well as non-stationary soft furniture. The problems in putting up a hammock has depended up until now in using natural existing factors, for example requiring two trees, or by using wall fittings, etc. The assembled hammock frame design, using today's technology, allows the putting up of a hammock without needing natural or stationary factors. The frame can be placed on any relatively flat surface and the hammock mounted on the frame.

The design of a light weight hammock frame without the need of natural existing or stationary support factors at today's level of technology can be seen as a desired objective. The main points to be improved upon are weight saving, handling and volume of transport. Also, existing frames are dependent upon the use of a flat ground surface. The goal of the present invention is the design of a hammock frame without these disadvantages, in order that the hammock frame can be used as a camping article or for picnics, or at the beach, etc. and for the limitless use during leisure hours in the "fresh air".

The packed up hammock frame of the present invention can be transported by car, by bicycle or carried as a back pack. The user of the hammock frame is protected against the elements by means of adjustable awnings. These characteristics allow the hammock frame to be used as a bed or as a tent on expeditions or as an emergency kit during rescue operations.

BRIEF DESCRIPTION OF THE INVENTION

The hammock frame of the present invention has a frame of keel like shape which is flexible. With the hammock supported between the ends of the frame under high tension (weight on the hammock and the frame), the frame will bend and lower the hammock toward the ground. With this function, the user is protected from frame accident and the frame cannot be overtensioned and will not break.

For this design, the frame has a flexible beam with a keel like shape. Supporting beam legs are connected by bags attached to the flexible beam, each bag having a pocket for accepting the supporting beam leg.

BRIEF DESCRIPTION,.OF THE DRAWINGS

DETAILED DESCRIPTION OF THE INVENTION

Figure 1:
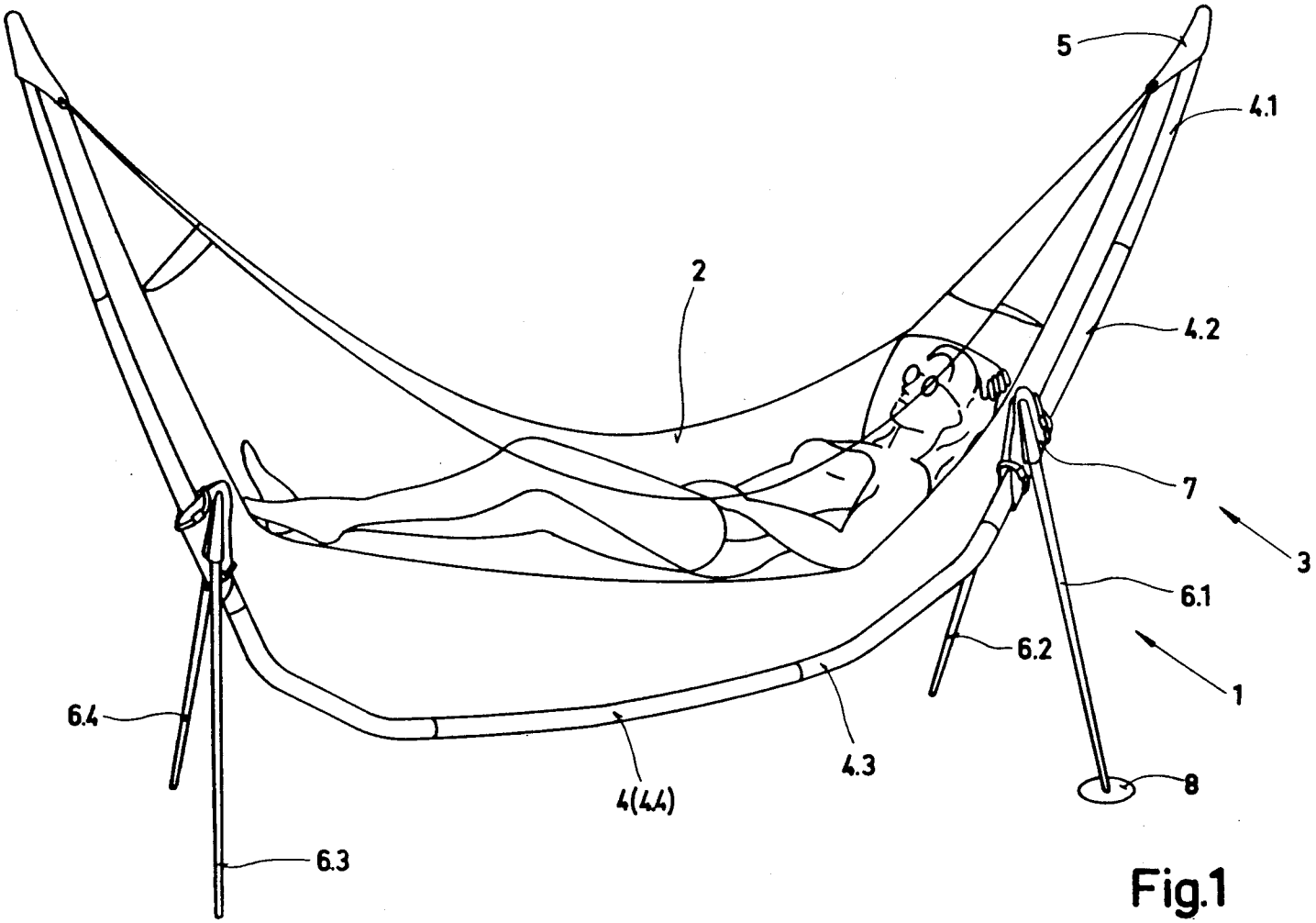
FIG. 1 is a perspective view showing the hammock mounted on the frame without weather protection.
Figure 2:
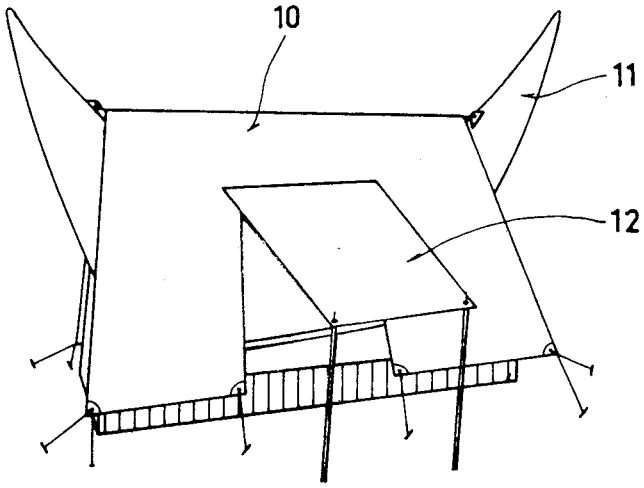
FIG. 2 is a perspective view showing the hammock frame with weather protection.
Figure 5:
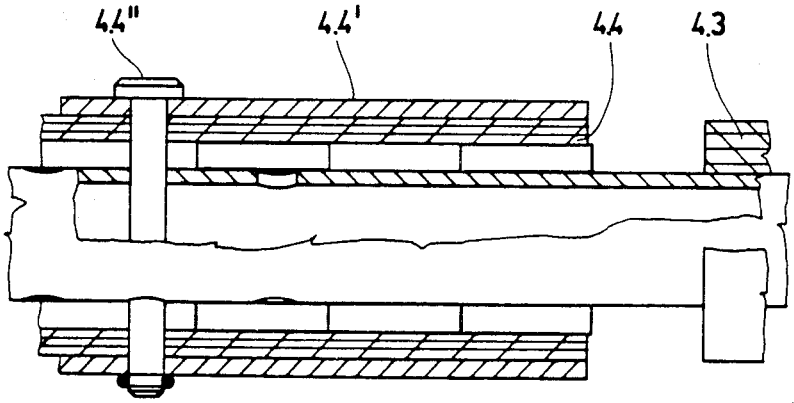
FIG. 5 is a plan view partly in cross-section of a telescopic joint of two elements of the flexible beam.

The hammock frame 1 of FIG. 1 includes a hammock 2 and a frame 3, the frame 3 having several tubular elements joined together to form a flexible beam 4. This flexible beam 4 has two top ends 4.1, two middle elements 4.2, two bow elements 4.3 and a straight central beam 4.4, which is adjustable in length by telescoping parts as shown in FIG. 5. As seen in FIG. 2, the overall shape of frame 4 is that of the keel of a boat.

The hammock 2 has a caplike end joint 5 attached to the frame 4 at each of the top ends 4.1 of the flexible frame 4. These caplike joints 5 are of weather proof high tensile fiber awning type material. (For example: Trade mark: Terilen, Dakron or Bainbridge).

The tubular elements of flexible beam 4 can be manufactured using a high tensile (AlCu) alloy, or composite carbon fiber. The flexible tubes are preferably rated to a stress load of 500 to 600 N/mm2. The same materials can be used for the supporting beam legs 6.1–6.4, which can have a similar design to ski-sticks, and each of which has an end attached to a middle beam element 4.2.

Ground surface conditions may require the use of foot plates 8, attached by a spherical joint to the bottom end of each of the supporting beam legs 6.1 to 6.4. The plates 8 for example can be made from reinforced polyamid fiber, or out of heat hardened steel (integrated and hidden in a soft foot plate). With the use of plates 8, the surface conditions on which the frame is to be supported can be either hard or soft.

Figure 3:
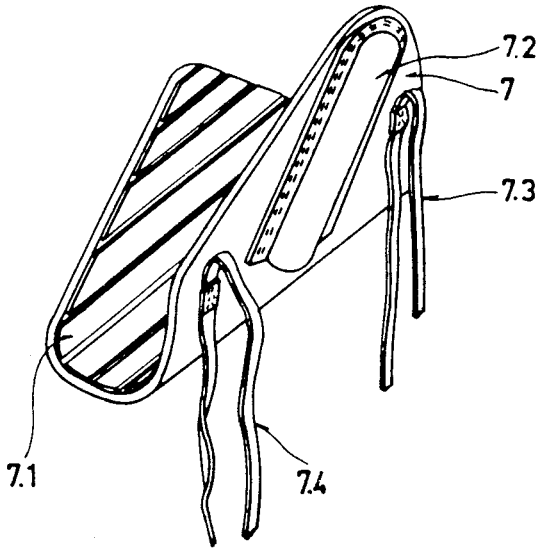
FIG. 3 is a perspective view showing a joint between the flexible beam and a beam leg.

The joint of the flexible beam 4 with the supporting beam legs 6.1 to 6.4 is preferably designed using textile fasteners of the engaging hook or loop and mushroom shaped elements, one such type called KLETTEN, made by Gottlieb Binder GmbH of Stuttgard, Germany formed as a bag 7 (see also FIG. 3). The bag 7 on the inside. The middle element 4.2 of the flexible beam 4 has the other type of the textile fastener in the area of the bag joint 7 which is glued on the tube with a suitable adhesive such as an epoxide glue. This way the flexible beam 4, the middle elements 4.2 and the bag 7 have a strong fit. It is important that the legs 6.1–6.4 are exactly positioned into the beam leg pockets 7.2 of the bag 7 (as shown in FIG. 1). The straps 7.3 and 7.4 are then wrapped around the bag 7 and secure the joint of the bag to the respective beam middle element 4.3. The size of the beam leg pockets 7.2 have to allow easy assembling and dismantling of the supporting beam legs 6.1 to 6.4. The length of the beam leg pockets 7.2 should be approximately 5 times the diameter of the tube forming the beam legs 6.1–6.4.

Figure 4:
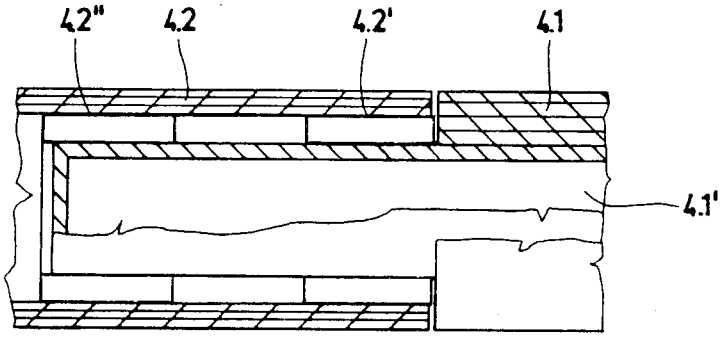
FIG. 4 is a plan view partly in, cross-section of a joint of two elements of the flexible beam.

In FIG. 4 the joint of the elements 4.1 to 4.4 of the flexible beam 4 is shown for example at the point where the beam elements 4.1 meet the middle elements 4.2. The middle element has two bushing tubes 4.2', 4.2'' glued in place in order that a tube bolt with a minimum length of 3 times its diameter can build the exact fitting. The tolerance of the fit should be a tight sliding fit.

FIG. 5 shows a design for a telescopic fit for connecting the bow elements 4.3 to the flexible beam central element. The design has a bushing tube 4.4' glued onto the flexible beam central element 4.4 in order to achieve a material conforming fit with the bolt 4.4'' which passes through an extension of the bow element 4.3 with bushings interposed. This design corresponds with FIG. 4.

FIG. 2 shows the hammock frame 1 with a tent 10. The top ends of the top elements 4.1 of the flexible beam 4 (see FIG. 1) have a bag-like joint adapted to the hammock frame in order to support the surface of the tent. The tent flap 12 can be locked with an internal zipper not seen from outside.

Figure 6:
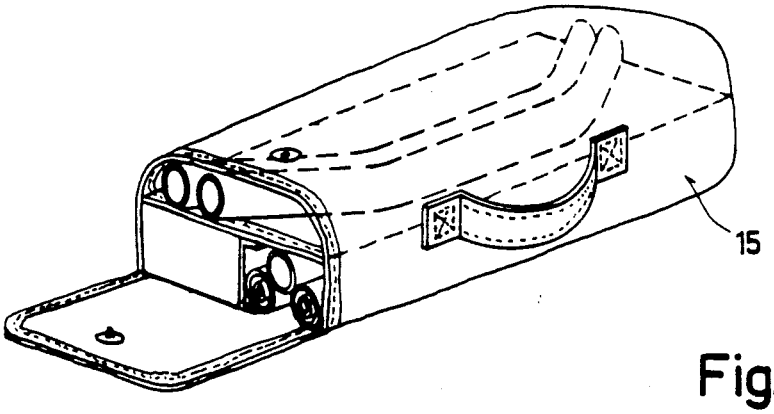
FIG. 6 shows a bag with the dismantled and packed up hammock and frame.

FIG. 6 shows a storage bag 15 with pockets of a length of approximately 1 meter for storing the components of the hammock and frame. The weight of the hammock frame is approximately 3 to 4 kg. With the tent, the weight is about 5 kg.

I claim:

1. The combination of a hammock and a frame for supporting the hammock, said frame comprising:

a flexible beam having a keel like shape with a lowermost central portion from which extend upwardly swept ends, a plurality of legs each having one end for contacting the ground and the other end for supporting the beam, means for attaching the other end of each of the legs to the beam, the length of each of the legs being such that the beams lowermost central portion is above the ground when there is no load on the hammock, a hammock for suspension between the ends of the flexible beam, loading of the hammock causing the beam parts off of the ground to deform in a direction to lower the hammock and to deflect the lowermost central portion of the beam toward the ground.

2. The combination of claim 1 wherein the beam is formed of a plurality of tubular elements which are attached together.

3. The combination of claim 2 wherein said elements are telescopically connected.

4. The combination of claim 2 further comprising means for fastening the tubular elements together.

5. The combination of claim 1 further comprising a bearing at each end of the beam for mounting an outer protective flexible covering.

6. The combination of claim 1 wherein said attaching means comprises a flexible bag attached to the beam, said bag having a pocket for receiving the end of a supporting leg.

7. The combination of claim 6 wherein said bag has a flap on which the pocket is located, said flap extending upwardly with one end of the supporting leg inserted in the pocket and the other end of the leg on the ground.

8. The combination of claim 7 wherein said bag has a pair of flaps each with a pocket for accepting an end of a respective supporting leg.

9. The combination of claim 1 further comprising a plate at the one end of each supporting leg to rest on the ground.

10. The combination of claim 1 further comprising a cap-like fitting on each end of the beam to which the hammock is attached.

* * * * *